US008580181B1

(12) United States Patent
Beachley et al.

(10) Patent No.: US 8,580,181 B1
(45) **Date of Patent: *Nov. 12, 2013**

(54) FABRICATION OF THREE DIMENSIONAL ALIGNED NANOFIBER ARRAY

(76) Inventors: Vince Beachley, Mt. Pleasant, SC (US); Xuejun Wen, Mt. Pleasant, SC (US)

( * ) Notice: Subject to any disclaimer, the term of this patent is extended or adjusted under 35 U.S.C. 154(b) by 336 days.

This patent is subject to a terminal disclaimer.

(21) Appl. No.: 12/896,268

(22) Filed: Oct. 1, 2010

Related U.S. Application Data

(62) Division of application No. 12/054,668, filed on Mar. 25, 2008, now Pat. No. 7,828,539.

(60) Provisional application No. 60/896,987, filed on Mar. 26, 2007.

(51) Int. Cl.
*B29C 47/00* (2006.01)

(52) U.S. Cl.
USPC ..... 264/465; 264/438; 264/452; 264/467; 264/484

(58) Field of Classification Search
USPC ..... 264/465, 438, 452, 467, 484; 425/115, 425/174.8 R, 174.8 E
See application file for complete search history.

(56) References Cited

U.S. PATENT DOCUMENTS

| | | | |
|---|---|---|---|
| 1,975,504 | A | 10/1934 | Formhals |
| 2,187,306 | A | 1/1940 | Formhals |
| 6,355,699 | B1 | 3/2002 | Vyakarnam et al. |
| 6,743,273 | B2 | 6/2004 | Chung et al. |
| 6,753,454 | B1 | 6/2004 | Smith et al. |
| 6,821,479 | B1 | 11/2004 | Smith et al. |
| 7,575,707 | B2 | 8/2009 | Xia et al. |
| 2002/0104606 | A1 | 8/2002 | Ohzuru et al. |
| 2005/0104606 | A1 | 5/2005 | Donsky |
| 2005/0137675 | A1 | 6/2005 | Dubson et al. |
| 2005/0224998 | A1 | 10/2005 | Andrady et al. |
| 2006/0226580 | A1 | 10/2006 | Xia et al. |
| 2007/0269481 | A1 | 11/2007 | Li et al. |
| 2007/0275458 | A1 | 11/2007 | Gouma |
| 2008/0290554 | A1 * | 11/2008 | Wu et al. ..... 264/211.12 |

OTHER PUBLICATIONS

Related U.S. Patent Application Form.
Dalton, et al., "Electrospinning with dual collection rings", *Polymer*, 46, (2005), pp. 611-614.
Li, et al., *Nano Letters*, 3 (8) 1167-1171, 2003—Abstract.

(Continued)

*Primary Examiner* — Richard Crispino
*Assistant Examiner* — Elizabeth Royston
(74) *Attorney, Agent, or Firm* — Dority & Manning, PA

(57) ABSTRACT

Disclosed are methods of forming three dimensional arrays of aligned nanofibers in an open, loose structure of any desired depth. The arrays are formed according to an electrospinning process utilizing two parallel conducting plates to align the fibers and rotating tracks to distribute the fibers throughout the array. Arrays can be used as formed, for instance in tissue engineering applications as three dimensional scaffolding constructs. As-formed arrays can be combined with other materials to form a composite 3-D structure. For instance, composite polymeric materials can be electrospun to form composite nanofibers within the array. Multiple polymeric materials can be electrospun at different areas of the array to form a composite array including materially different nanofibers throughout the array. The arrays can be loaded with other fibrous or non-fibrous materials to form a composite array. Arrays can also be rolled to form a uniaxial fiber bundle.

9 Claims, 11 Drawing Sheets

(56) References Cited

OTHER PUBLICATIONS

Katta, et al. , "Continuous Electrospinning of Aligned Polymer Nanofibers onto a Wire Drum Collector", *Nanoletters*, (2004), vol. 4, No. 11, pp. 2215-2218.

Related US Application Form.

Teo et al., "Electrospun fiber bundle made of aligned nanofibers over two fixed points",*Nanotechnology*, 16, (2005), pp. 1878-1884.

* cited by examiner

Fig. 6A
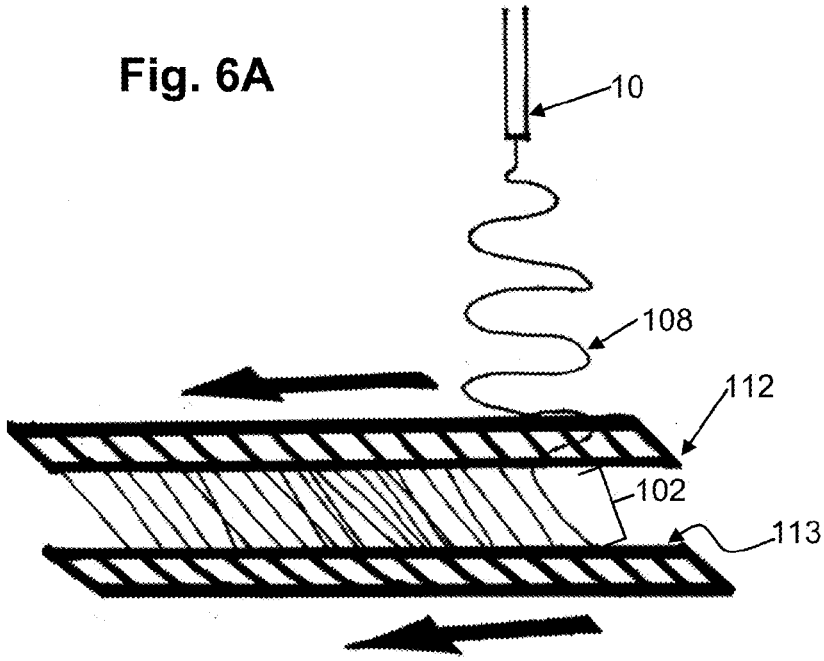
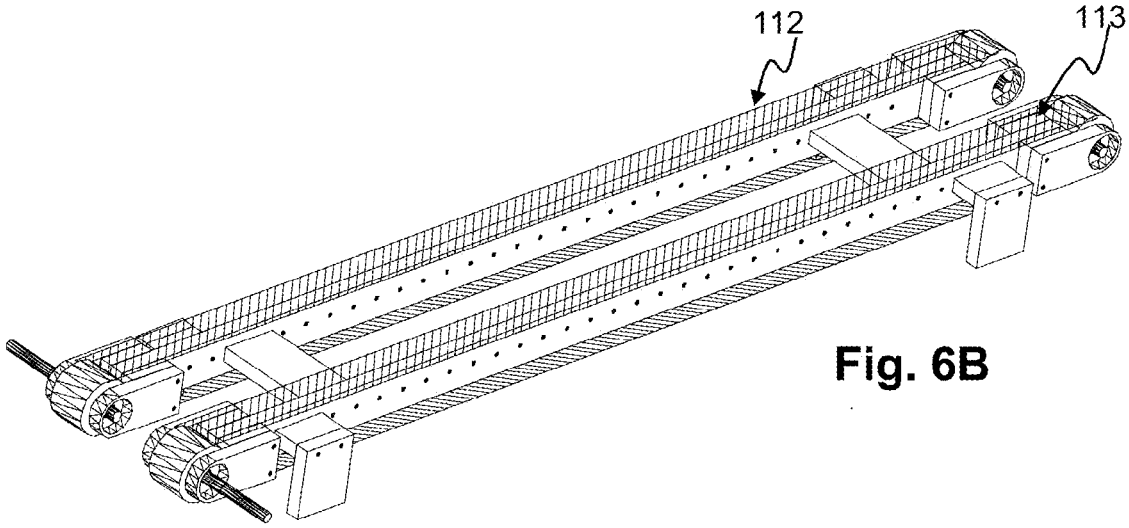
Fig. 6B

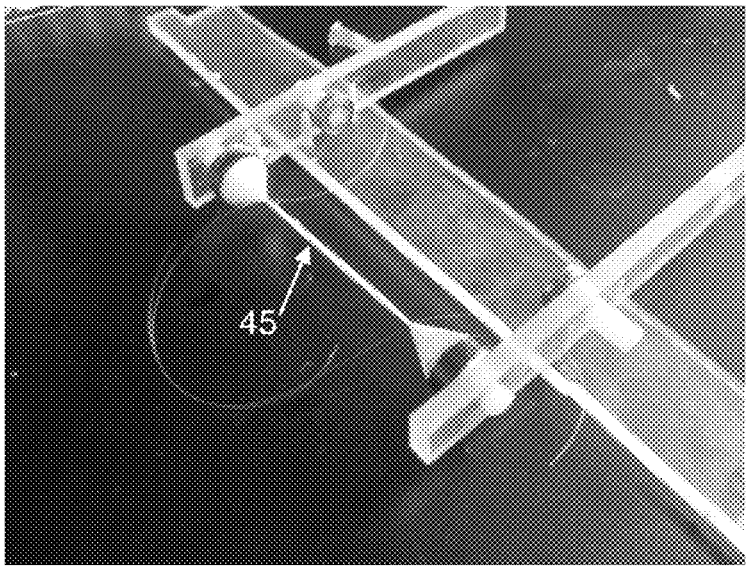
Figure 9
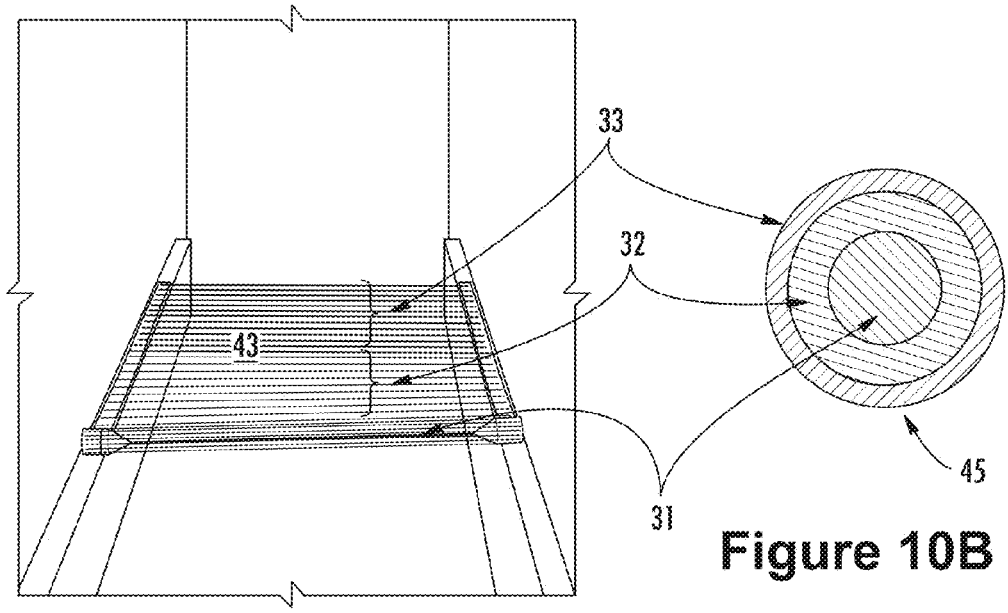
Figure 10B
Figure 10A

FABRICATION OF THREE DIMENSIONAL ALIGNED NANOFIBER ARRAY

CROSS REFERENCE TO RELATED APPLICATION

The present application is a divisional application of U.S. patent application Ser. No. 12/054,668 having a filing date of Mar. 25, 2008, which claims filing benefit of U.S. Provisional Patent Application Ser. No. 60/896,987 having a filing date of Mar. 26, 2007, which is incorporated herein in its entirety.

FEDERALLY SPONSORED RESEARCH AND DEVELOPMENT

The United States Government may have rights to this invention pursuant to a grant from the National Institute of Neurological Disorders and Stroke, grant number R01NS050243.

BACKGROUND

The basic concept of electrostatic spinning (or electrospinning) a polymer to form extremely small diameter fibers was first patented by Anton Formhals (U.S. Pat. No. 1,975,504). Electrostatic spun fibers and nonwoven webs formed therefrom exhibit very high surface areas and can be formed from a wide variety of polymers and composites. These materials have traditionally found use in filtration applications, but have begun to gain attention in other industries, including in nonwoven textile applications as barrier fabrics, wipes, medical and pharmaceutical uses, and the like. Due in part to the extremely high surface area of electrospun nonwoven webs, these materials also show promise in development of electrochemical materials such as electrochemical capacitors.

FIG. 1 illustrates a generic electrostatic spinning process including a rotating mandrel. The basic process consists of the use of a high voltage supplier 15 to apply an electrical field to a polymer melt or solution 30 held in a capillary tube 10, inducing a charge on the individual polymer molecules. Upon application of the electric field, a charge and/or dipolar orientation will be induced at the air-surface interface 60. The induction causes a force that opposes the surface tension. At critical field strength, the electrostatic forces will overcome surface tension forces, and a jet 40 of polymer material will be ejected from the capillary tube 10 toward a conductive, grounded surface such as a take-up reel 24. The jet 40 is elongated and accelerated by the external electric field as it leaves the capillary tube 10. As the jet 40 travels in air, some of the solvent can evaporate, leaving behind charged polymer fibers which can be collected on the take-up reel 24 driven by motor 26. As the fibers are collected, the individual and still wet fibers may adhere to one another, forming a nonwoven web 50 on the take-up reel 24.

Improvements to the basic process have been developed over the years. For instance, FIG. 2 illustrates a method of electrospinning fibers in an aligned orientation. According to this process, parallel conductive silicon plates on either side of an air gap (FIG. 2A) produce an electric field (FIG. 2B) that aligns the deposited fibers across the air gap (FIG. 2C) (see, e.g., Li, et al., Nanoletters, 2003, 3:8, 1167, which is incorporated herein by reference). This method has been used to collect two dimensional arrays of aligned and oriented fibers. Aligned nanofibers can show greater versatility as compared to random nonwovens formed by previous methods. For instance, oriented fibers are more favorable for tissue engineering applications due to the capability of directional guidance during tissue development. When considering textile or other materials applications, webs of oriented fibers present the possibility of developing anisotropic characteristics in the materials. Moreover, aligned fibers are more conducive to textile manufacture.

Dense three dimensional fiber arrays have also been formed by forming multiple layers of aligned fibers over one another in the air gap between the static conductive plates of FIG. 2A. Unfortunately, problems still exist with the aligned fiber arrays formed to date. For instance, methods to date provide limited fiber collection because as the charged, aligned fibers are piled upon one another, an increasing charge repels new fibers from being deposited on the formed mesh. Hence, arrays formed to date are of limited thickness. In addition, as fibers are collected one on top of another, the newly formed, still wet fibers adhere and bond to adjacent fibers above and below within the web. As a result, the as-fabricated arrays are very dense with little porosity. This prevents utilization of the arrays in applications that otherwise may be very well-suited to the extremely small diameter fibers. For instance, the dense arrays cannot be utilized in bioengineering applications as scaffolding material, as the dense mats can only allow cells to grow on the surface, and development of a three dimensional cellular construct throughout the depth of the array is not possible.

What are needed in the art are improved methods for forming three dimensional arrays of aligned nanofibers. In addition, what are needed in the art are three dimensional arrays of nanofibers that can be formed to any desired depth with an open, loose structure.

SUMMARY

In one embodiment, a method of forming an array of nanofibers is disclosed. A method can include, for example, electrospinning a nanofiber from an electrospinning nozzle, and depositing the nanofiber at a deposition area. More specifically, the deposition area can be defined as a gap between a first collection surface and a second collection surface, the first and second collection surfaces being separated from one another by the gap. Upon deposition, one end of the nanofiber is adhered to the first collection surface and the other end of the nanofiber is adhered to the second collection surface. Following deposition, the collection surfaces move such that the nanofiber is moved in a direction away from the deposition area. A second nanofiber can then be formed and deposited at the deposition area subsequent to the motion of the first nanofiber away from the deposition area.

Arrays formed according to the disclosed methods can thus include a plurality of electrospun nanofibers in a more open construct than electrospun arrays formed in the past. For instance, individual fibers of disclosed arrays can have little or no chemical bonding to adjacent fibers of the array. For instance, any adherence between individual fibers of the array can be due to electrostatic attraction or physical entanglement, with no chemical bonding due to solvent drying or polymer melting between fibers. Disclosed arrays can have much lower fiber density than previously known electrospun webs and arrays.

Also disclosed herein are systems for forming an electrospun array. For instance, a system can include an electrospinning nozzle, a first collection surface and a second collection surface defining the deposition area therebetween. The first collection surface and the second collection surface are capable of motion such that following deposition of a fiber in the deposition area the fiber is moved away from the deposition area prior to deposition of the next fiber of the array.

BRIEF DESCRIPTION OF THE DRAWINGS

A full and enabling disclosure, including the best mode thereof, to one of ordinary skill in the art, is set forth more particularly in the remainder of the specification, including reference to the accompanying figures, in which:

FIGS. 6A and 6B are representations of another embodiment of a process as disclosed herein;

FIG. 9 is a tied uniaxial fiber bundle as may be formed according to processes as described herein;

FIG. 10 illustrates one embodiment of a composite uniaxial fiber bundle during formation (FIG. 10A) and in cross-section (FIG. 10B);

Figure 1:
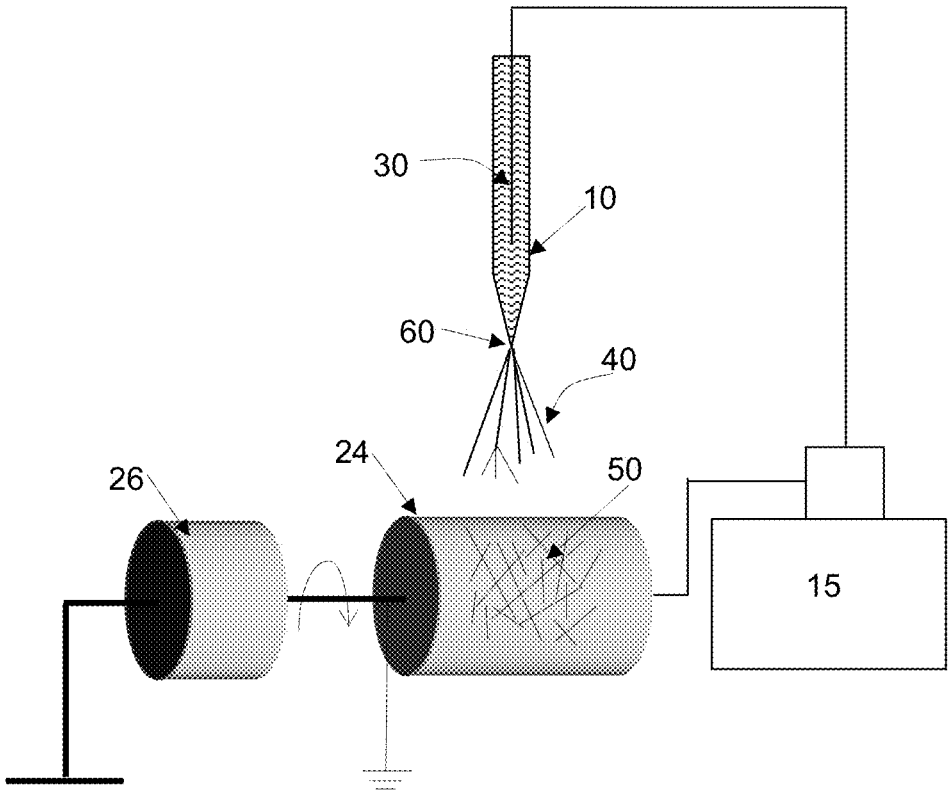
Figure 1 Prior Art
FIG. 1 is a schematic diagram of a typical prior art electrostatic spinning process.

Repeat use of reference characters in the present specification and drawings is intended to represent the same or analogous features or elements of the present invention.

DETAILED DESCRIPTION

Reference will now be made in detail to various embodiments of the disclosed subject matter, one or more examples of which are set forth below. Each embodiment is provided by way of explanation, not limitation, of the subject matter. In fact, it will be apparent to those skilled in the art that various modifications and variations may be made in the present disclosure without departing from the scope or spirit of the disclosure. For instance, features illustrated or described as part of one embodiment, may be used in another embodiment to yield a still further embodiment. Thus, it is intended that the present subject matter cover such modifications and variations as come within the scope of the appended claims and their equivalents.

The present disclosure is generally directed to methods of forming three dimensional (3D) arrays of aligned nanofibers. More specifically, the arrays can be formed of any material that can be electrospun and can be formed with a more open structure than electrospun nanofiber formations known in the past. More specifically, electrospinning systems as disclosed herein can include a mobile fiber deposition location such that individual fibers can be moved away from the deposition location following formation and deposition of the fiber. Disclosed arrays can be formed to any desired depth and length, with the width of an individual 3D array being limited only by the electrospinning process itself. Beneficially, disclosed formation methods allow for a consistent electrical field to be maintained during formation of an array and as a result an array can be formed to a much larger size than electrospun arrays known in the past. Moreover, continuously collected fiber arrays as disclosed herein can be maintained with fibers that are not chemically bound to one another.

In one embodiment, an as-formed array as disclosed herein can be further processed following initial formation to form a structure of a specific size, shape, and/or porosity. For instance, multiple arrays can be combined together to form a larger composite array of a desired shape. In another embodiment, a formed array can be shaped following formation, for instance an as-formed array can be rolled to form a uniaxial fiber bundle.

Arrays as disclosed herein can be utilized in a wide variety of applications. For instance, uniaxial fiber bundles as disclosed herein can be utilized in textile, biological, and electrochemical applications, among others. As-formed arrays can be combined with other materials to form composite 3-D structures. In one embodiment, an array can be loaded with biologically active materials, including living cells, growth factors, nutrients, and the like, and can function as a 3-D tissue engineering scaffold.

Figure 3:
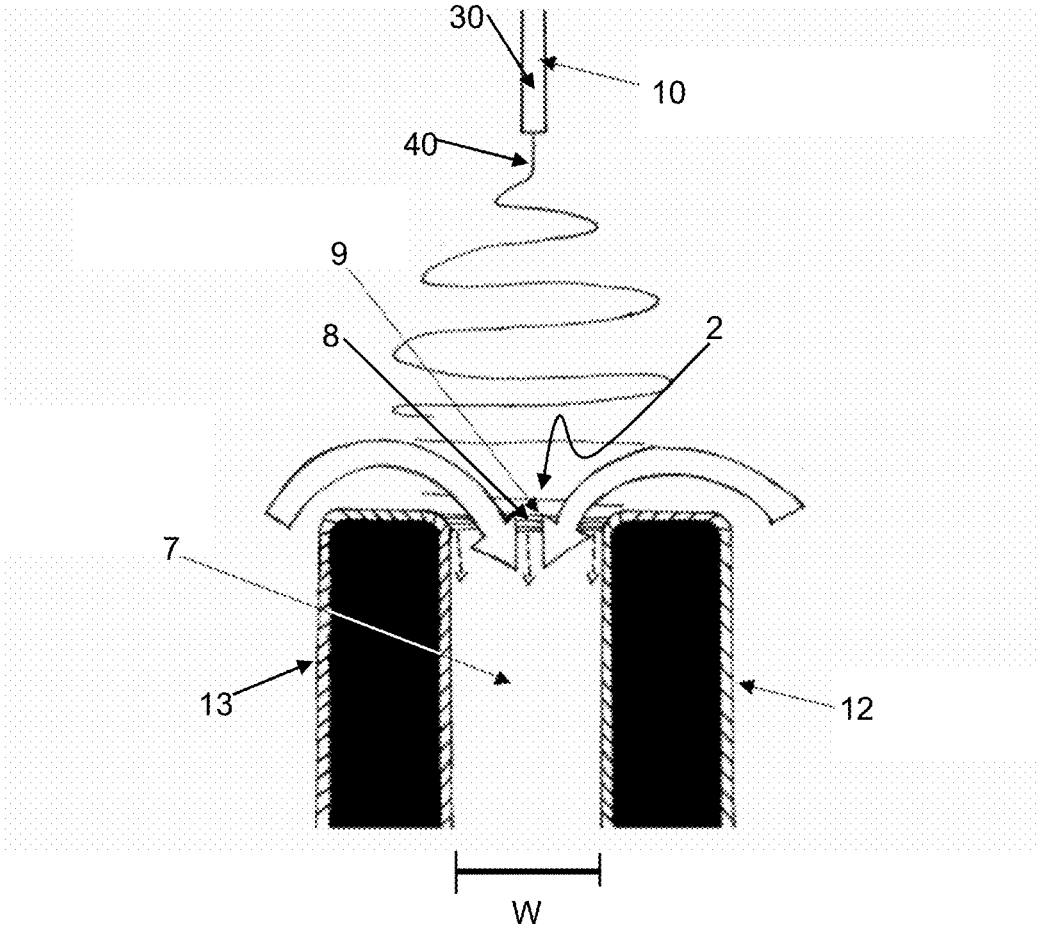
FIG. 3 is a schematic diagram of one embodiment of a process as disclosed herein that may be utilized to form a loose, three dimensional aligned nanofiber array.

FIG. 3 is a schematic representation of one embodiment of an electrospinning process as described herein. According to the illustrated process, an electrospinning nozzle 10 can be loaded with any polymeric composition 30 suitable for use in an electrospinning process as is known in the art. For instance, a polymer, sol-gel, or composite solution or melt may be loaded into the electrospinning nozzle. Solutions and melts encompassed by the process can include homopolymers, block copolymers, random copolymers, polymeric blends, and so forth.

In one preferred embodiment, a polymeric composition, e.g., a polymer-containing solution or melt, can include an ecologically friendly and/or biologically compatible polymer. For instance, polymers that have been found suitable for use in biological applications such as alginates, polylactides, and the like can be utilized. In one embodiment, poly(hexano-6-lactone) (commonly referred to as $\epsilon$-caprolactone or PCL) can be electrospun according to the disclosed processes. PCL is an aliphatic polyester that is a relatively stable synthetic polymer under usual conditions and is biodegradable under microbial attack. As such, PCL has garnered a great deal of interest for application in forming biodegradable plastics. In addition, PCL is biologically compatible and has been utilized extensively in forming tissue engineering scaffolds (see, e.g., U.S. Pat. No. 6,355,699 to Vyakarnam, et al., which is incorporated herein by reference).

Mixtures of materials can be electrospun in disclosed processes so as to form composite nanofibers, as is known in the art. For instance, a solution including one or more polymers in combination with a non-polymeric additive can be electrospun to form composite fibers. Additives can generally be selected based upon the desired application of the formed array. For example, one or more polymers can be electrospun with a biologically active additive that can be polymeric or non-polymeric, as desired. By way of example, a 3D array can include an electrospun polymer in conjunction with one or more biologically active materials such as drugs, growth factors, nutrients, cells, proteins and the like. The secondary material can be incorporated in the fibers during formation as is known in the art, for example as described in U.S. Pat. No. 6,821,479 to Smith, et al., U.S. Pat. No. 6,753,454 to Smith, et al., and U.S. Pat. No. 6,743,273 to Chung, et al., all of which are incorporated herein by reference.

Additives as may be incorporated in an array in conjunction with electrospun polymer fibers can be provided for any desired purpose. For instance, additives can provide desired physical characteristics to formed fibers such as tenacity, modulus, color, and so forth. In one embodiment, additives can be incorporated to provide a more direct benefit to the user. For instance, an additive can be a biologically active agent that can be released into a surrounding area upon degradation of a polymer of a fiber. For instance, during use, as a polymeric component of an electrospun fiber degrades, a biologically active agent incorporated into the fiber during formation can be released. For example, a drug, a cofactor, a nutrient, or the like can be incorporated into a fiber during formation and the additive can be released for delivery to a targeted site, for instance an in vivo delivery site or a cellular construct developing within the 3-D array, upon degradation of a polymer component of the array.

Individual fibers of an array can include polymeric and/or nonpolymeric materials in a random mixture throughout the fiber or in an ordered arrangement. For instance core/shell composite nanofibers can be formed with different materials forming the core and the shell. Formation methods for core/shell nanofibers have been described. For example, U.S. Patent Application Publication No. 2006/0226580 to Xia, et al., which is incorporated herein by reference, describes methods for forming core/shell and tubular nanofibers as may be utilized in 3D arrays as described herein.

A polymeric solution that is loaded into an electrospinning nozzle can include any suitable solvent. Selection of solvent can be of importance in determination of the characteristics of the solution, and hence of the characteristic properties of the nanofibers formed during the process. For instance, acetic acid, acetonitrile, m-cresole, tetrahydrofuran (THF), toluene, dichloromethane ($CH_2Cl_2$), methanol (MeOH), dimethylformamide, as well as mixtures of solvents are typical of solvents as may be utilized in disclosed processes.

As is generally known in the art, the critical field strength required to overcome the forces due to surface tension of the solution and form a jet will depend on many variables of the system. These variables include not only the type of polymer and solvent, but also the solution concentration and viscosity, as well as the temperature of the system. In general, characterization of the jet formed, and hence characterization of the fibers formed, depends primarily upon solution viscosity, net charge density carried by the electrospinning jet and surface tension of the solution. The ability to form the small diameter fibers depends upon the combination of all of the various parameters involved. For example, electrospinning of lower viscosity solutions will tend to form beaded fibers, rather than smooth fibers. In fact, many low viscosity solutions of low molecular weight polymers will break up into droplets or beads, rather than form fibers, when attempts are made to electrostatically spin the solution. Solutions having higher values of surface tension also tend to form beaded fibers or merely beads of polymer material, rather than smooth fibers. Thus, the preferred solvent for any particular embodiment will generally depend upon the other materials as well as the formation parameters, as is known in the art.

Referring again to FIG. 3, a polymeric composition 30, e.g., a solution or melt, can be loaded into an electrospinning nozzle 10. According to standard electrospinning methodology, upon application of a suitable voltage to the needle (generally on the order of about 5 to about 30 kV), the repulsive electrostatic forces induced at the liquid/air interface will overcome the surface tension forces, and a jet 40 of liquid will be ejected, as shown. The jet is first stretched into a Taylor cone structure. As the jet 40 travels toward the grounded deposition area, some of the solvent can evaporate, leaving behind charged polymer fibers 8, 9. As can be seen, the deposition area 2 can be between two spaced apart collection surfaces 12, 13. Accordingly, the charged polymer fibers 8, 9 can align in the air gap, i.e., in the deposition area 2, between the collection surfaces 12, 13, as illustrated, with either end of the fibers 8, 9 adhering to the respective collection surface 12, 13, as shown. In this particular embodiment, the deposition area 2 is near the top of a collection compartment 7.

Figure 2:
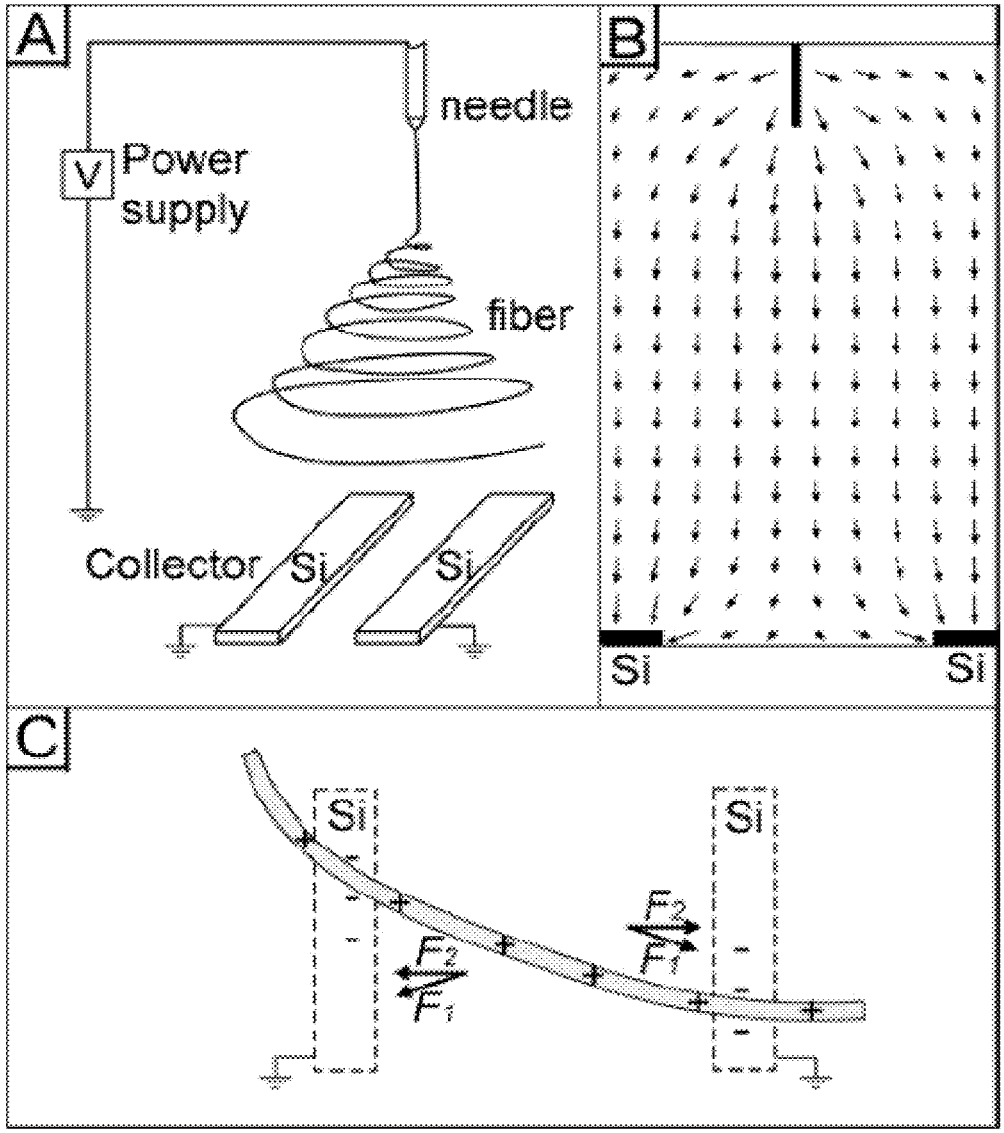
Figure 2 Prior Art
FIG. 2 is a schematic diagram of a prior art electrostatic spinning process used to form an aligned two dimensional nanofiber array.

The relationship between the conductive collection surfaces 12, 13 and the applied voltage at the needle produces an electric field, similar to that of the static system illustrated in FIG. 2B, that aligns the nascent fibers 8, 9 and causes deposition of the fibers in generally parallel alignment across the gap between the two collection surfaces 12, 13 in the deposition area 2. Materials as may be utilized in forming the collection surfaces 12, 13 can be any conductive material as is generally known in the art. For example, collection surfaces 12, 13 can be the same or different as one another and can include, without limitation, aluminum, copper, a laminate structure including a surface layer of a conductive material, or the like.

In contrast to previously known systems, the system includes the capability of mobility such that following deposition in the deposition area 2, the nascent fibers can be moved away from the deposition area 2. For instance, in the embodiment illustrated in FIG. 3, the collection surfaces 12, 13 of the system can be endless tracks formed of a conductive material that move as illustrated by the directional arrows in FIG. 3 and move the newly formed fibers away from the deposition area 2 and into collection compartment 7.

Surfaces 12, 13 can generally be separated from one another by a distance W of between about 2 mm up to about 10 cm, or even greater in other embodiments, for instance up to about 20 cm or even greater. In one embodiment, fibers of a length of up to about 50 cm can be formed. Maximum possible width, W, is generally understood to be related to fiber diameter, as well as other formation parameters. For instance, in one embodiment, discussed further in the examples section, below, nanofibers with average diameters from about 350 nm to about 1 μm and having a length of between about 35 and about 50 cm can be formed. Accordingly, W of a 3-D array incorporating such fibers would likewise be between about 35 and about 50 cm. In another embodiment, W can be between about 2 cm and about 9 cm.

During formation, an individual fiber 8 can be deposited in the air gap between the collection surfaces 12, 13, as shown. Collection surfaces 12, 13 can rotate down through the collection compartment 7, and the newly formed fiber 8, which is adhered to the collection surfaces 12, 13 at either end of the fiber 8, can move down into the collection compartment 7 with the moving collection surfaces 12, 13. Beneficially, an individual fiber 8 can move away from deposition area 2 and down into collection compartment 7 prior to deposition of a second fiber 9 immediately above fiber 8. Thus, there can be space between the two fibers 8, 9. As such, remaining solvent on a fiber 8, 9 can dissipate and the fibers can dry while separated from one another such that the individual fibers that form a finished array need not be tightly adhered to one another.

Figure 4A:
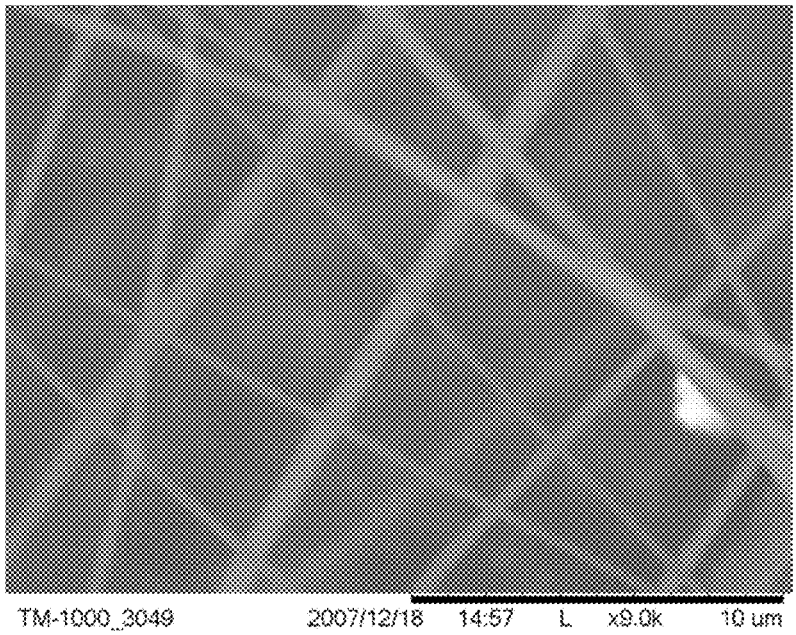
FIG. 4A is a scanning electron micrograph (SEM) of a portion of an array as disclosed herein.
Figure 4B:
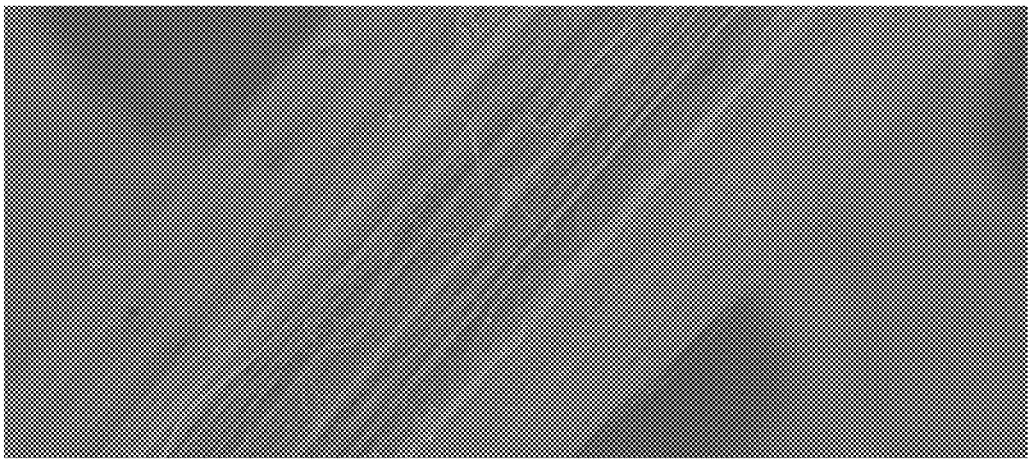
FIG. 4B is an SEM of a uniaxial fiber bundle formed as described herein.

In one embodiment, loose arrays as disclosed herein can be formed such that there is no adhesion between individual fibers due to binding prior to or during the evaporation of solvent between fibers, i.e., there is no adhesion between fibers due to the drying and binding of unevaporated solvent in the array following fiber formation. Similarly, when considering an electrospinning process that includes formation of nanofibers from a melt, the array can be formed such that there is no adhesion between individual fibers due to binding prior to or during setting, i.e., there is no adhesion between fibers due to the cooling and binding of the melt. Accordingly, there can be no chemical bonding between fibers and any adhesion between fibers can be due only to either electrostatic binding between fibers or fiber entanglement. This characteristic can be seen in FIGS. 4A and 4B. FIG. 4A is an SEM of an as-formed fiber mat illustrating the loose, porous nature of the mat in which the individual fibers are not chemically bound to one another due to the evaporation of solvent or cooling of melt following formation of the fibers. As can be seen the mat defines porosity including pores on the scale of about 10 μm to about 100 μm. FIG. 4B illustrates a uniaxial fiber bundle that can be formed from an as-formed mat, and described in more detail below. As can be seen the fiber bundle includes loose, individualized fibers with some physical fiber entanglement, and no chemical bonding between individual fibers.

Figure 5A:
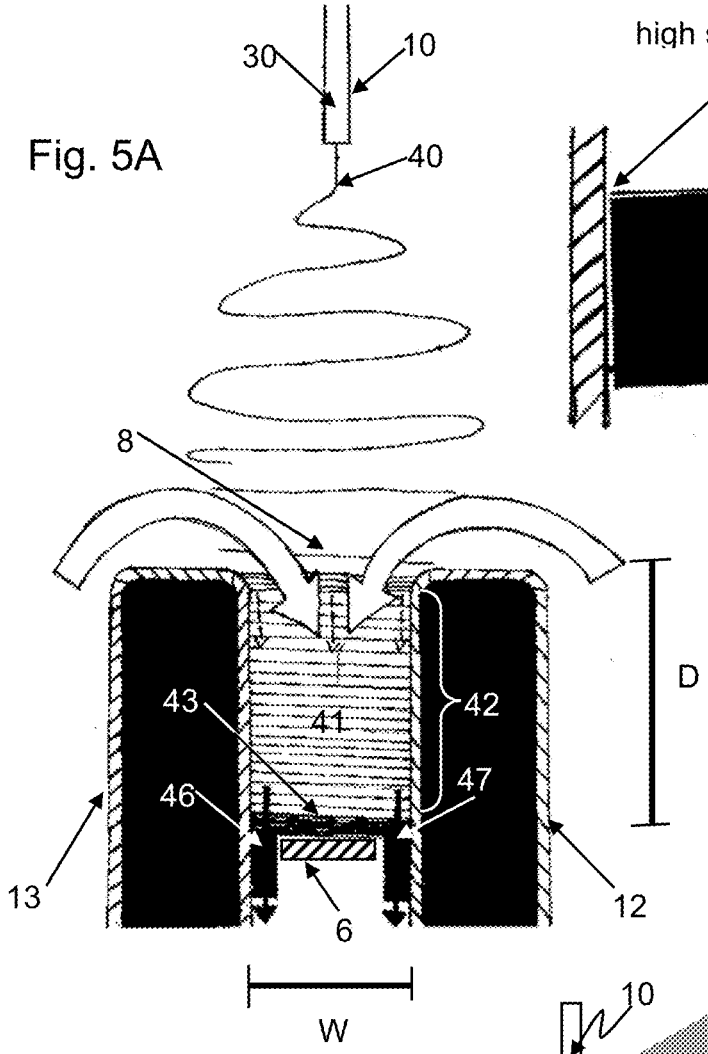
FIG. 5A is a schematic representation of one embodiment of a 3D aligned fiber array according to disclosed methods during formation.
Figure 5B:
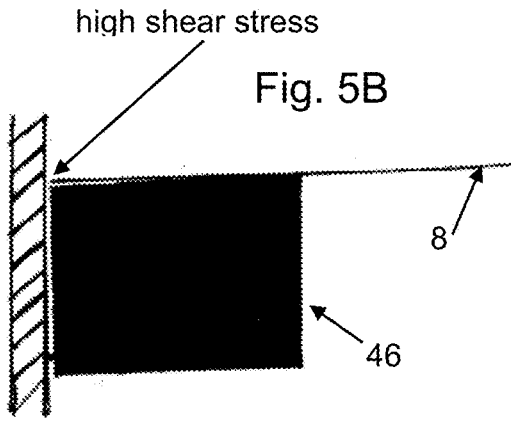
FIG. 5B shows a detail of a formation process as imaged in FIG. 5A, and FIG. 5C sets out the width, depth and length dimensions of an array as utilized in the discussion.
Figure 5C:
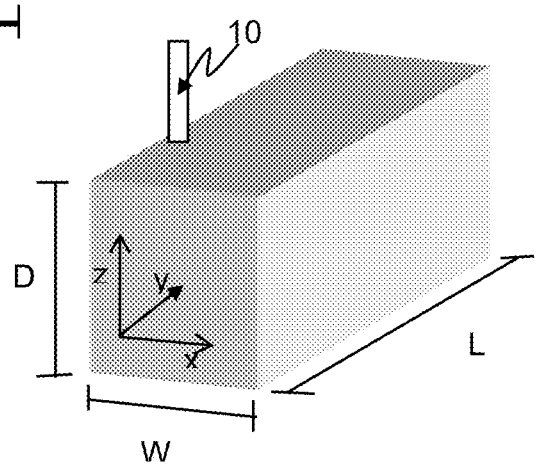

For clarity, FIG. 5C schematically illustrates dimensional terms utilized throughout the present disclosure. For example, arrays as may be formed according to the disclosed processes can include a depth D, width W, and length L, as shown. The depth D can correspond to a z-coordinate that can be defined by the central axis of the electrospinning nozzle, as shown in FIG. 5C. Thus, the width of a generally orthogonal array can be defined as lying along the x coordinate of the system and the length of the array can be defined as lying along the y-coordinate of the system defined by the axis of the electrospinning nozzle, as illustrated. It should be understood, however, that arrays as described herein can be formed to any suitable shape, and utilization of the terms length, width, and depth are not intended to imply any required shape for arrays formed according to processes as described herein.

FIGS. 5A-5B illustrate aspects of an array formation process as illustrated in FIG. 3 somewhat farther along in the formation process. The speed of the collection surfaces 12, 13 can control the vertical distance between fibers of the nascent array. For instance, surfaces 12, 13 can move at a speed of between about 1 cm/min and about 100 cm/min, for instance about 40 cm/min. Slower and faster speeds for the collections surfaces 12, 13 are possible in other embodiments. For instance, in another embodiment, collection surfaces 12, 13 can move at a speed of between about 0.5 cm/min and about 100 cm/min, or at speeds greater than 100 cm/min in other embodiments. Fiber density of the array can thus be controlled, as fiber density will increase with decreasing speed of the collection surfaces 12, 13. A system can define a minimum formation speed of collection surfaces 12, 13. At the minimum formation speed no new fibers will collect at deposition area 2 due to charge repulsion from the previously formed fibers. The minimum formation speed for any particular embodiment can depend upon the nature of the formed fibers, the width W of the array, the induced charge, and the like.

In one embodiment, a system can include an additional ground plate 6, at the base of collection compartment 7 as shown in FIG. 5A. Ground plate 6 can help prevent build up of repulsive charge between formed fibers, and as such can prevent fiber breakage and encourage formation of deeper arrays.

As illustrated in the embodiment illustrated in FIG. 5A, a 3D array 41 can be formed to a desired depth D. Array 41 can be held between collection surfaces 12, 13 and used as formed, for instance as a tissue engineering scaffold.

In another embodiment, fibers can be detached from collection surfaces 12, 13. For instance, as shown in FIG. 5B, the system can include stationary support blocks 46, 47. As the collecting surfaces 12, 13 continue to move down through the collection compartment 7, they can carry the electrospun fibers along with them to the base of the collection compartment 7 where they can pass support blocks 46, 47. As the collection surfaces 12, 13 move past support blocks, 46, 47, individual fibers can be cut from the collection surfaces 12, 13 due to shear forces at the support block/collection surface interface, as shown in FIG. 5B. Of course, a component of a system for removing a fiber from a collection surface need not be in the illustrated form of a stationary support block. Any suitable component can be included to remove the fibers such as, without limitation, a blade, a wedge, a plate, or any other shaped device that can be utilized to shear or cut the fiber from the collection surface.

Following detachment from the collection surfaces 12, 13, the now dry, aligned fibers can collect in a loose mat 43 at the base of collection compartment 7. Mat 43 can be formed to any desired depth and can include nanofibers in a loose, low density formation, with very little adhesion between individual fibers, e.g., only electrostatic and/or adhesion due to fiber entanglement, and a relatively large amount of open space and porosity within the mat. For instance, an array in the form of a loose array that has been detached from the collection surfaces can define pores between 0 (i.e., no porosity, for instance following compression) and about 650 $mm^2$. For instance, average pore size can be greater than about 0.5 $mm^2$, for example between about 0.5 $mm^2$ and about 600 $mm^2$, between about 1.5 $mm^2$ and about 125 $mm^2$, between about 4.0 $mm^2$ and about 70 $mm^2$, or between about 15 $mm^2$ and about 50 $mm^2$. Individual pore sizes can be smaller, as previously mentioned. For instance, average pore diameter can be on the micrometer scale, for instance greater than about 10 μm, in one embodiment, or between about 10 μm and about 200 μm, between about 50 μm and about 100 μm, in another embodiment.

The motion of a deposited fiber away from the deposition area can be in any direction, and is not limited the z-direction as defined by the electrospinning nozzle and as illustrated in FIGS. 3 and 5, above. For instance, in another embodiment, illustrated in FIGS. 6A and 6B, following deposition at a deposition area 102 between collection surfaces 112, 113, a formed fiber 108 can move away from the deposition area 102 while remaining in the same plane of formation, as shown, i.e., in a direction normal to that direction defined by electrospinning jet. According to this embodiment, an extremely thin, long construct can be formed that can be used as is or can be combined with similar or different constructs to form a final structure. The capability of forming such loose fibrous constructs via the disclosed gentle assembly techniques that can allow extra time for fibers to dry and avoid tight adhesion between fibers can facilitate the fabrication of complex structures including electrospun fibers. For instance, disclosed formation processes can provide 3-D fibrous constructs having controlled fiber packing density that can allow for the optimization of void volume.

Figure 7:
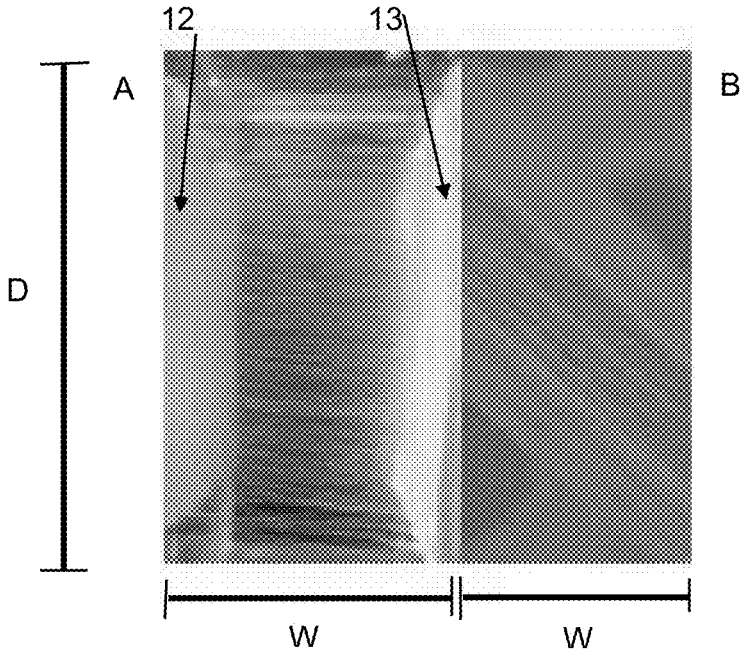
FIGS. 7A and 7B are photographs of 3D arrays formed according to processes as described herein.

Though the array formation systems discussed above can provide the collection surfaces moving consistently parallel and at the same speed as one another, this is not a requirement of the disclosed methods. For instance, FIG. 7A is a photograph of an array held within a collection compartment following formation. The array of FIG. 7A was formed while the two collection surfaces 12, 13 moved in parallel and at the same speed. As can be seen, the individual fibers are at an approximately 90° angle to the collection surfaces 12, 13 throughout the depth D of the array. This is not a requirement of a system, however. By way of example, in another embodiment, the speeds of the two collection surfaces 12, 13 can be different, such that the vertical space between individual nanofibers of the array can vary across the width W of the array, and the individual nanofibers can be at an angle to the collection surfaces 12, 13 other than the approximately 90° angle of the fibers shown in FIG. 7A. In another embodiment, the speeds of the collection surfaces can be varied throughout the formation process, such that the fibers can be at varying angles to one another throughout the depth of an array. For instance, a portion of the array can include fibers at a first angle to the collection surfaces, e.g., about 90°, and a second portion can include the fibers at a different angle to the collection surfaces, e.g., about 80°. Thus, the disclosed formation processes can provide for a great deal of versatility in the orientation of the fibers throughout the depth of a formed array.

The relationship of the fibers of the array to the surrounding material can also be varied following formation of the array. For example, the array of FIG. 7B was formed as described above and as illustrated in FIG. 7A, with the collection surfaces 12, 13 moving at the same speed as one another. Following formation of the array, and while the individual fibers were still adhered to the collection surfaces 12, 13, the bundle was skewed somewhat such that the formed nanofibers are at an angle other than 90° to the collection surfaces through the depth D of the array.

Disclosed formation processes can also provide for versatility in the materials used to form a 3D array. For example, the polymeric composition ejected from the electrospinning nozzle can be varied throughout the depth of the array. According to one such embodiment, following formation of a first depth of an array from a first polymer solution, the motion of collection surfaces 12, 13 can be stopped while a second, different polymer solution is loaded into the electrospinning nozzle 10, and then formation can resume.

Different polymeric compositions can differ by any one or more components. For instance two different polymeric compositions can differ by solvent composition, which can lead to nanofibers being formed of identical materials, but having different diameters. In one embodiment, the polymers of two different nanofibers can be the same, and the nanofibers can differ by some secondary additive. Of course, the fibers can also differ from one another by one or more polymer components of the fibers. For instance, the microstructure of a polymer fiber can be varied through alteration of formation conditions such as solution characteristics including, viscosity and additives, through variation in applied voltage, and the like.

Referring again to FIG. 5, following loading of a different polymer solution in the electrospinning nozzle 10, motion of the collection surfaces 12, 13 can begin again as the second polymer solution is ejected from the nozzle 10. Thus, the nanofibers can differ by polymer, diameter, secondary additive, or the like through the depth of the array.

Though illustrated in the Figures as utilizing a single electrospinning nozzle, it should be understood that the disclosed processes are not limited to this particular embodiment. Use of a single nozzle in the embodiment illustrated in FIGS. 3 and 5 can generally form an array of between about 5 and about 20 cm in length Las shown in FIG. 5C, due to the scattering of the jet. In one embodiment in which a longer array is desired, multiple nozzles can be utilized. Alternatively, a system such as that illustrated in FIG. 6 can be utilized to form a long, thin array, or an array can be moved in multiple directions throughout the formation process. For instance, the deposition area can be rotated during formation of the array so as to vary the geometry of the fibers throughout the depth and/or length of the array. Rotation of the collection device during formation can also be utilized to develop a desired porosity in the 3D array, as discussed further below.

In another embodiment, a system can include multiple tracks, so as to move the individual fibers in multiple directions. For instance, a first set of tracks could move the nascent web in a direction normal to the ejection jet, while a second set could move the web in a vertical direction. Accordingly, 3D webs of a variety of sizes and shapes could be formed.

In yet another embodiment, disclosed electrospinning systems and methods can be utilized in combination with other fabrication techniques such as rapid prototyping for formation of 3D constructs including a combination of desirable materials and/or geometries.

When utilizing a plurality of nozzles, adjacent nozzles can eject the same or different polymeric solutions. For instance, a first electrospinning nozzle can eject fibers from a first polymeric composition and a second, adjacent electrospinning nozzle can eject fibers from a second, different polymeric composition. Thus, a formed 3D array can comprise different fibers at various locations throughout the length of the array.

Following initial formation of an array, an as-formed array can be processed to a desired shape and size. For example, and referring to FIG. 8, in one embodiment, an as-formed 3D array can be rolled to form a uniaxial fiber bundle. According to this embodiment, an array can be removed from the collection surfaces 12, 13 prior to formation. For instance, an as-formed array can be in the form of a loose mat 43 of fibers, as described above in reference to FIG. 5. Beginning at a first end mat 43 can then be rolled, as shown, to form a uniaxial fiber bundle 45. The fiber bundle 45 can be rolled with a tension to have a predetermined amount of porosity. FIG. 9 is a photograph of one embodiment of a uniaxial fiber bundle 45 formed according to methods as disclosed herein that has been tied at either end.

As described above, the disclosed 3D arrays can be formed to include a plurality of different nanofiber types. Referring to FIG. 10A, a 3D array is shown that has been removed from collection surfaces to form a loose nanofiber mat 43 as described above. The array includes three different nanofiber types 31, 32, 33 along the length L of the array as defined above. The nanofibers forming the array vary as to nanofiber type across the length of the array, as shown in FIG. 10A. Following formation of the 3D nanofiber mat 43, the composite array can be rolled to form a uniaxial fiber bundle 45. In this embodiment, the uniaxial fiber bundle 45 will be a composite fiber bundle including a variety of nanofiber materials at different locations throughout the bundle, as shown in FIG. 9B. Specifically, first nanofibers 31 can form a core of the bundle, second nanofibers 32 can form a layer over the core, and third nanofibers can form an outer shell layer on the bundle.

Figure 11:
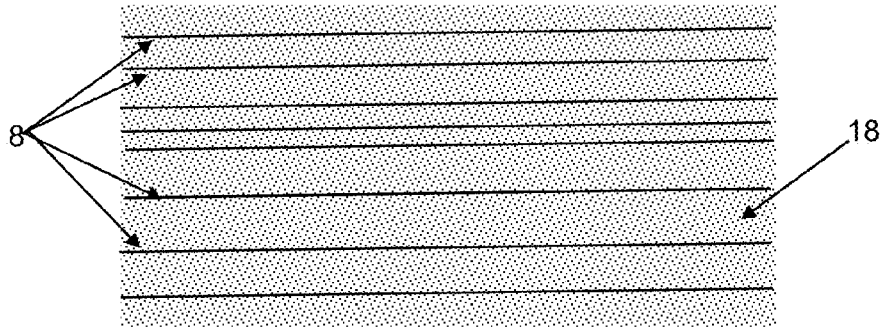
FIG. 11 is a schematic of a composite 3D structure including a 3D array of nanofibers held within a gelatin.

Following formation, a 3D array as described herein can be combined with other materials to form a composite construct. For example, FIG. 11 is a schematic of one embodiment of a composite construct including a plurality of aligned nanofibers 8 held within a polymeric matrix 18. A wide variety of materials can be combined with a 3D array to form a composite array, for instance a polymer solution can be simply poured, injected, or the like so as to encapsulate at least a portion of the fibers of an array and can fill the air space of the 3D array. Following cure of the polymer, the nanofibers can be held within the polymer matrix.

Other materials as may be combined with the 3D arrays following formation of the array can include colloids, other fibrous materials, and the like. For instance, a 3D array can be incorporated with a polymeric gel, as described above, and the encapsulating gel can be loaded with additional materials.

In one embodiment, a secondary material can be included with an array in order to form an outer or inner surface on the array. For instance, a secondary material can be included as an outer wrap, for example a nonporous, non-fibrous outer wrap, over a uniaxial nanofiber bundle. Similarly, the core of a uniaxial fiber bundle can be formed of a non-fibrous material, a micro- or macro-fibrous material, and so on.

In one embodiment, a biologically active material can be combined with an array, for instance with a higher density mat 43 so as to incorporate the agent in a uniaxial fiber bundle 45 formed from the mat 43. A biologically active agent can be incorporated in the polymeric solution that forms the fibers as described above and thus exist in the mat 43 within the fibers themselves. A biologically active agent can also be added to a mat 43 following formation thereof, for instance within a separate layer formed in conjunction with a formed mat 43. Upon formation of a fiber bundle 45, the biologically active agent will thus be incorporated within the bundle. In one embodiment, an agent can be released during use of the fiber bundle, for instance upon degradation of the nanofibers forming the array or upon diffusion of the biologically active agent from within the fiber bundle following location of the bundle in a desired environment. For instance, a biologically active agent such as a drug, nutrient, or some other material as may be beneficially delivered to a target location in a biological system can be incorporated within or on a 3D construct as described herein. Accordingly, a 3D array can be utilized as a delivery vehicle for delivering a biologically active agent to a targeted location, and in one particular embodiment, to an in vivo location.

In one preferred embodiment, disclosed 3D arrays can be utilized as scaffold materials in bioengineering applications. According to one such embodiment, a formed 3D array, either an array including individual fibers that are maintained at a distance from one another, for instance adhered to the surfaces of the movable collection plates, as described above, or an array in the form of a loose but still quite porous mat in which adjacent fibers are not tightly adhered to one another, can be loaded with living cells, growth factors, nutrients, and so forth. According to this particular embodiment, the 3D array can be porous enough so as to allow growth and extension of a developing tissue construction throughout the depth of the array, while still providing structural integrity to the cells during growth and development thereof. For instance, a loose mat can be coated with a composition including living cells, growth factors, nutrients, etc. following which the mat can be rolled and/or otherwise shaped to provide a scaffold with a desired orientation. In another embodiment, an as-formed array, including individual fibers that are maintained at a predetermined distance from one another can be loaded with the cells, nutrients, etc.

The disclosed subject matter may be better understood with reference to the following examples.

Example 1

Fibers were electrospun from polymer solutions containing 8, 11, 14, 17, and 20% w/v PCL (Mn 80,000, Sigma) and 0.06% w/v NaCl. A 7:3 mixture of dichloromethane (DCM, Alfa Aesar) and methanol (Fisher Scientific) respectively was used as the solvent. To prepare polymer solutions, 6 mg of NaCl was dissolved in 3 ml of methanol and the resulting solution was added to 7 ml of DCM. The desired amount of PCL was then added to obtain the appropriate concentrations. A second 14% PCL solution was mixed without the addition of NaCl. The PCL solutions were transferred to 5 ml syringes and connected to a 30, 23, or 21 gauge blunt tipped needles with polyethylene tubing. The needle tip was connected to a high voltage power source (Gamma High Voltage ES40P-10W) operating at 10, 15 or 20 kV, and polymer solution was feed into the needle at a rate of 0.010, 0.017, or 0.025 ml/min by a syringe pump (Medex inc. Medfusion 2010i). Two identical grounded aluminum plates were used as the collecting device. Three different sizes of plates were used. Dimensions were 30.5×7.5×0.7, 15×4×0.35, and 7.5×2×0.15 cm for large, medium, and small plates respectively. The plates were placed flat with an orientation that made their heights 7.5, 4, or 2 cm and arranged to be parallel along the longest dimension with a gap between them.

The air gap between the two plates was set at a distance estimated to be close to the maximum collectable fiber length and the needle tip was kept at a height equal to the distance between the parallel plates. The gap between the plates and the drop height of the needle tip were adjusted in 2.5 cm increments to determine the maximum distance at which polymer fibers could be collected across the parallel plates.

In group one, polymer concentration was varied with plate size set at 30.5×7.5×0.7 cm and NaCl concentration set at 0.06%. In group two, plate size was varied with polymer concentration set at 14% and NaCl concentration set at 0.06%. In group three, NaCl concentration was varied with polymer concentration set at 14% and plate size set at 30.5×7.5×0.7. Data was collected for all values in each group for all possible combinations of 10, 15, and 20 kV and 0.010, 0.017, and 0.025 ml/min.

Figure 12:
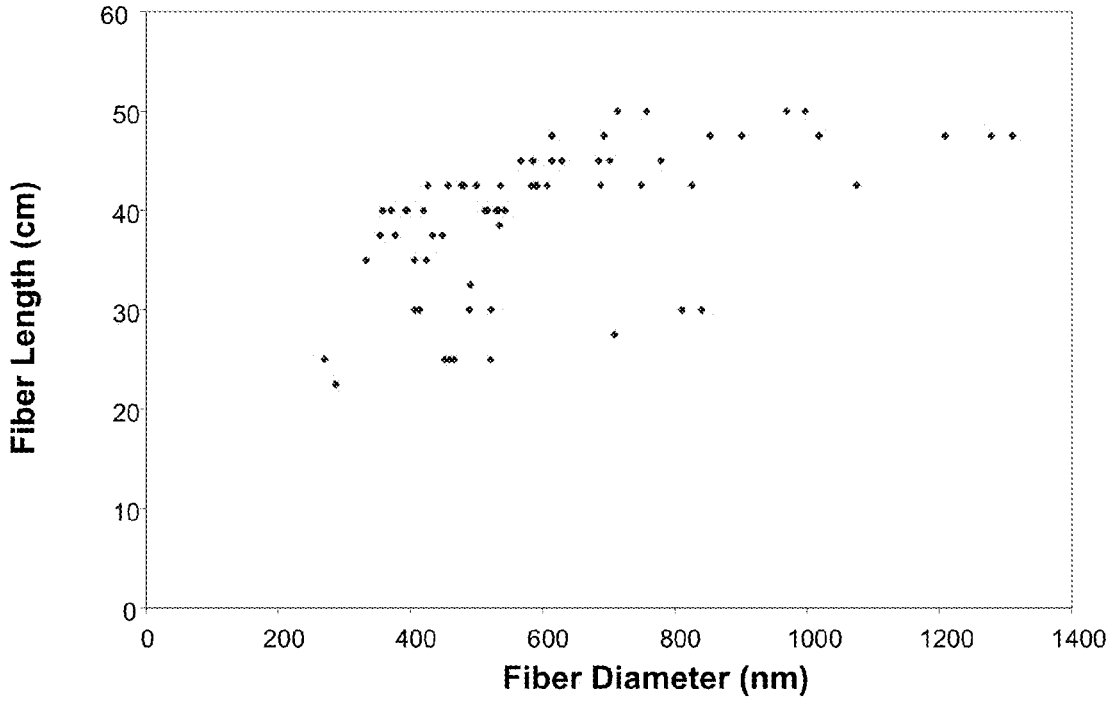
FIG. 12 illustrates various sizes of electrospun nanofibers as may be formed according to processes as disclosed herein.

Maximum collectable fiber length was compared to fiber diameter (FIG. 12). As can be seen, fibers having diameters up to about 1300 nm and lengths of about 50 cm were obtained.

Example 2

Fibers were electrospun through a needle from solutions of ϵ-caprolactone (poly(hexano-6-lactone), PCL) dissolved in solvents including a mixture of dichloromethane and dimethylformamide. Applied voltage was 5-20 kV, drop heights were 7-15 cm, and flow rates were between 0.0008-0.032 ml/min. Specific parameters for runs are shown below in Table 1, below.

TABLE 1

| fiber diameter (nm) | 250 | 500 | 1000 |
|---|---|---|---|
| voltage (kV) | 15 | 10 | 10 |
| drop height (cm) | 8 | 11 | 11 |

TABLE 1-continued

| PCL in solution (wt. %) | 6 | 11 | 15 |
|---|---|---|---|
| solvent | $CH_2Cl_2$:MeOH (7:3) | $CH_2Cl_2$:MeOH (7:3) | $CH_2Cl_2$:MeOH (7:3) |
| needle gauge | 30 | 23 | 21 |
| feed rate (ml/min) | 0.010 | 0.010 | 0.025 |
| NaCl added | 0.06 wt/v % | 0 | 0 |

Fibers were vacuum dried to evaporate any residual solvent and bundled for an in vitro neurite outgrowth assay. Aligned fibers in dense mats were used as control. In addition, the aligned 3D individual fibers were functionalized by direct loading brain-derived neurotrophic factor (BDNF, 0.000125 wt/v % added to the formation solution) into the nanofibers during the electrospinning process. To slow down the BDNF release, heparin was also loaded into the nanofibers during the spinning process (0.00575 wt/v % added to the formation solution). BDNF release was measured over four weeks using ELISA. Dorsal Root Ganglion cells (DRGs) were cultured on 3-D bundles of varying fiber diameters and BDNF concentrations. Neurite outgrowth was evaluated and compared for different scaffold compositions.

Devices similar to that illustrated in FIG. 3 were used to collect 3-D fiber arrays with fiber lengths (W) of 2.5, 4.5, and 9 cm and array areas of 15, 60, and 135 $cm^2$, respectively. The mobile collecting track moved at approximately 0.5 cm/min. A uniform aligned fiber distribution was present throughout the 3-D arrays as shown in FIG. 7A.

Formed mats were roiled to fabricate fiber bundles of average diameters of 250 nm, 500 nm, and 1 mm and used as scaffolds for in vitro culture of DRGs. Heparin and BDNF were also incorporated into nanofibers at different concentrations (heparin at 0 wt. %, 0.05 wt. %, 0.28 wt. %, and 0.56 wt. % by weight of PCL in solution, and BDNF at 0.0109 mg/mg PCL).

Example 3

A system such as that illustrated in FIG. 5 was constructed to form 3D nanofiber arrays. All raw materials for constructing the device were obtained from Smallparts (Miramar, Fla.). The frames of the devices were constructed from 0.25 inch thick polycarbonate sheets and were held together with screws. 4.95 mm diameter rods inserted into 5 mm bearings along the top and bottom of the long sides of the box provided a base to rotate the tracks. The bearings at the bottom of the frame were fixed, but an adjustable piece was constructed to allow variation of the distance between the rods and adjustment of the tension in the tracks.

To form the collection surfaces, 0.008 in thick latex mats were cut into 20×32 cm rectangles, super glued into 20 cm width bands and stretched around the rods after removal of the side panel of the frame. Vertical strips of double sided magnetic SEM tape (Electron Microscopy Sciences) were used to cover the latex mats and the SEM tape was put under tension. Finally a sheet of aluminum foil was place on top of the SEM tape.

To control motion of the collection surfaces, the rods on the bottom of the box extended out 5 mm and were connected to Animatics Smart Motors (4-40C) using metal collars. Two separate motors were used to turn each of the lower rods and thus move the tracks at a controlled speed. The motion of the motors was controlled using Animatics Smart Motor Data Logger software.

Polycaprolactone (PCL Mn=80,000, Sigma), polyurethane (PU, Texoflex SG-80A) and a PCL-PU polymer were electrospun from polymer solvent solutions. PU was dissolved in hexafluoro-2-propanol (HISP, Oakwood) at 5-7% wt/v and PCL-PU was dissolved in dichloromethane:dimethylformamide (3:1) (DCM:DMF, Sigma) at concentrations of 13-17% wt/v. PCL was dissolved in DCM:Methonal (Fisher Scientific) (7:3) at concentrations of 5-15% and in DCM:DMF (3:1) at concentrations of 13-18%. Polymer solution was fed by a syringe pump (Medex inc. Medfusion 2010i) at feed rates of 0.010-0.020 ml/min through 1/16" polyethylene tubing into a 30, 23, or 21 g blunt tipped needle. A voltage of 8-20 kV was applied to the needle tip with a high voltage power supply (Gamma High Voltage ES40P-10W). The needle tip was held 5-20 cm above the level of the parallel tracks. The tracks of the device were grounded.

Figure 13:
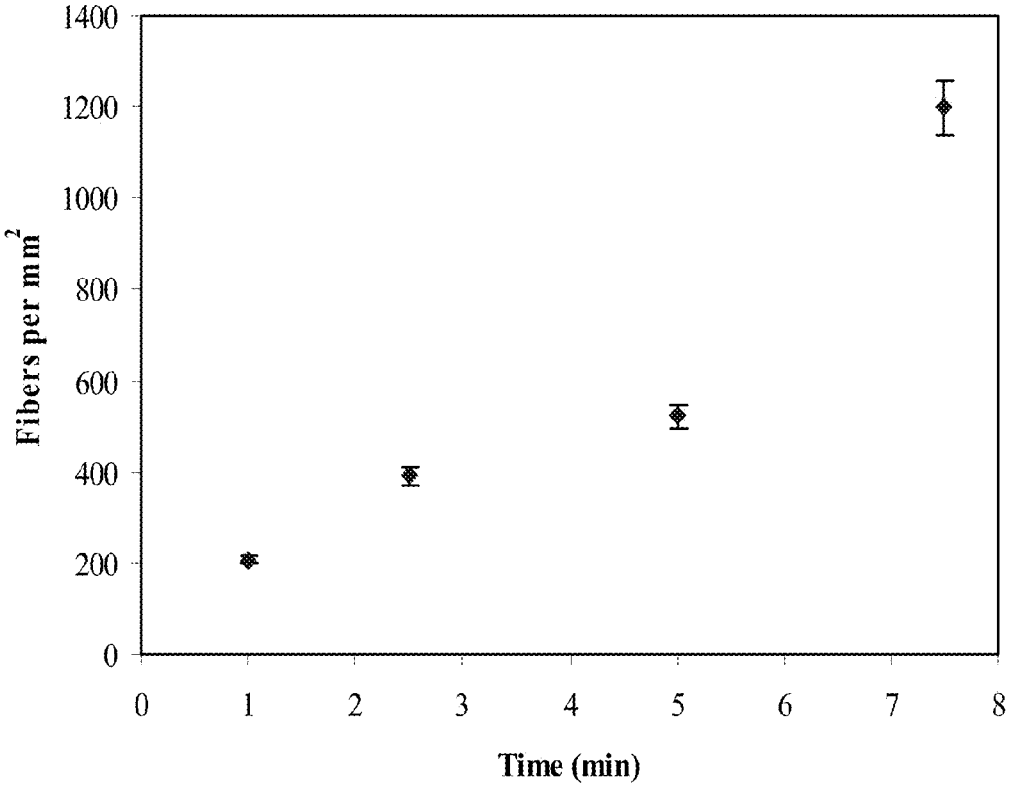
FIG. 13 graphically illustrates the deposition rate of nanofibers utilizing one embodiment of a system as disclosed herein.

Two parallel strips of SEM tape were placed on microscope stub and an aligned fiber array was collected for 1 minute, 2.5 minutes, 5 minutes, or 7.5 minutes in an orientation perpendicular to the tape. Samples were analyzed using SEM and fibers per unit length in the direction of the tape was counted using ImagePro Plus 4.0. Six to nine measurements were averaged for each of three trials per collection time. The exact electrospinning parameters for the fiber rate were 18% PCL solution dissolved in 3:1 DCM:DMF was fed through a 23 g needle 11 cm above the collection area at 0.015 ml/min with an applied voltage of 12 kV. Results are shown in FIG. 13. As can be seen, the fiber collection rate was found to be linearly uniform with time. Moreover, these fiber collection rates were found to be continuous up to a maximum attempted time period of five hours.

Figure 14:
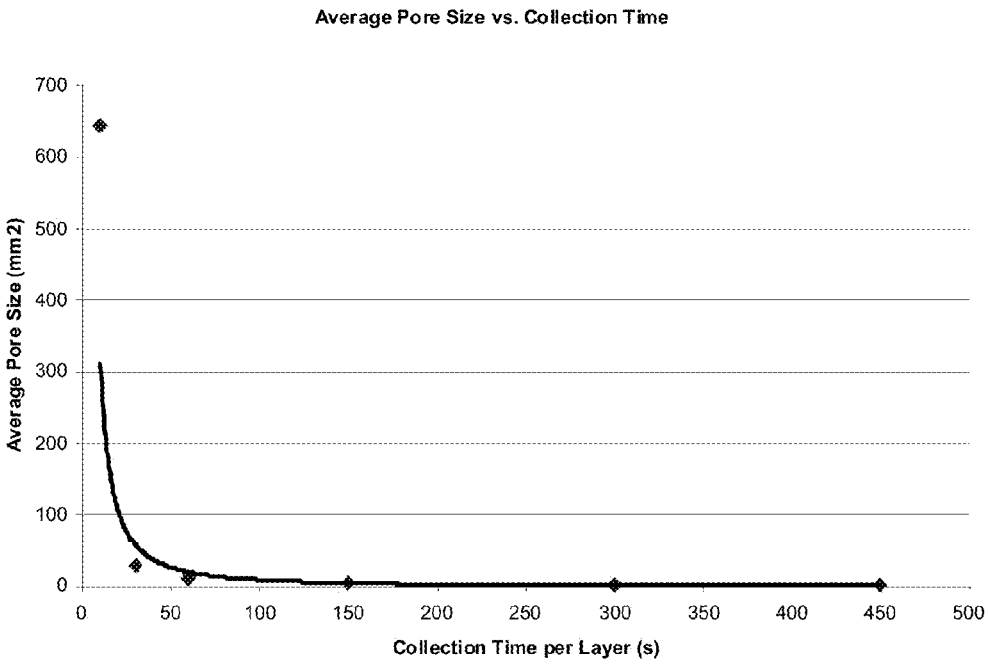
FIG. 14 illustrates variation in porosity obtained for arrays formed as described herein.

Squares of SEM tape were placed on SEM stubs. The inner dimensions of the squares were 8×8 mm. Fiber arrays were collected for 10 seconds, 20 seconds, 30 seconds, 1 minute, 2.5 minutes, and 5 minutes. Four layers of fiber arrays were collected for each collection time and transferred to the SEM stubs. The stub was rotated 90° between each layer to make a crisscross pattern. The exact electrospinning parameters were 18% PCL solution dissolved in 3:1 DCM:DMF was feed through a 23 g needle 11 cm above the collection area at 0.015 ml/min with an applied voltage of 12 kV. Each four layer sample was analyzed using SEM and pore area was measured using ImagePro Plus 4.0. 112-132 pores were measured for each of three trials per collection time. FIG. 14 illustrates the results. As expected, pore size was found to be related to collection time by a power law. A thin elastic nanofiber mater formed with a crisscross pattern as described was found to successfully support embryonic cardiac tissue.

Unidirectional aligned nanofiber array mats were collected by addition of a 26×8.5 cm polycarbonate rectangular rack inside of the collecting device as illustrated in FIGS. 4B and 4C. The rack was held in place by holders placed on the collecting device. A 0.25 cm space was left between the edge of the rack and the wall of the collecting device to allow the mobile track to pass in between. Shear forces generated on the fibers as the track moved past the rack easily broke the fibers off the mobile track leaving the fibers deposited perpendicularly across the rack. The ends of the fibers were either naturally adhered to the surface of the rack or secured by adhesive tape. To prevent fiber bending during to static charge built up, a metal ground plate was placed below the rack. Fibers collected across the rack were pulled down toward the metal plate where they were allowed to discharge. Because the fibers were allowed to dry completely before touching the metal plate, they were easily removed from its surface. Tendon fibroblast cells and nerve cells were separately seeded into the nanofiber arrays and both cell types were found to align well in the direction of the fiber direction.

Figure 8:
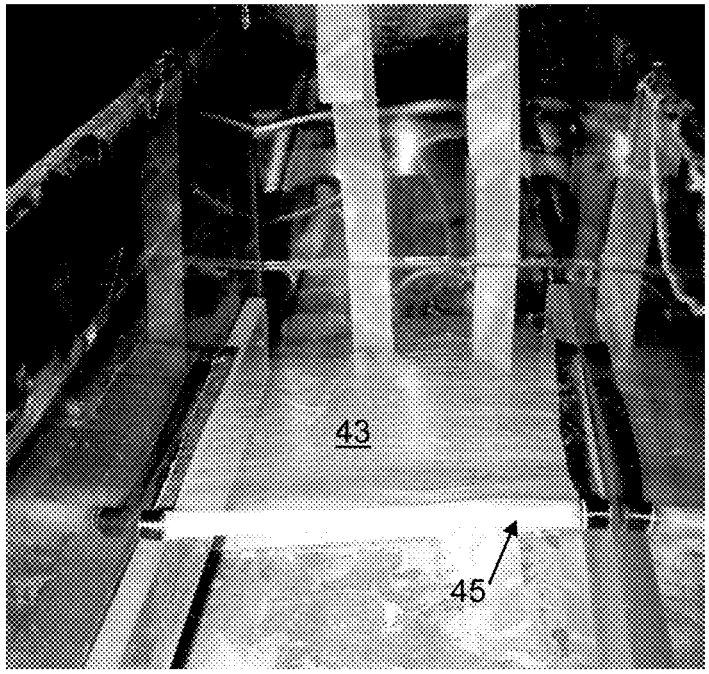
FIG. 8 illustrates a formation process for a uniaxial fiber bundle as may be formed according to the disclosed subject matter.

Fiber bundles were fabricated by rolling up fiber arrays formed as described above and tying the ends off with nylon thread as illustrated in FIGS. 8 and 9. A custom rolling device was assembled that had two wheels on each side of the collecting device. The cylindrical fiber array was then tied into a bundle at the ends or the center and was cut off the rollers.

Three-dimensional rectangular structures with controlled fiber density were produced by stacking linear arrays of fibers as described above with spacers between each layer. PCL nanofibers were collected for approximately 20 second intervals and stickers of approximately 50 μm thickness were manually placed in between layers as spacers. Approximately 50 layers were collected. An aligned fiber structure having a depth of approximately 3 mm thick was constructed. The structure was then immersed in deionized water and again analyzed. The stacked array structure remained intact after water immersion.

Example 4

A system such as that illustrated in FIG. 6 was constructed to form 3D nanofiber arrays. The frame of this design was assembled as two separate pieces using the same materials utilized in Example 3. For each piece, an 18×0.75 in polycarbonate bar was used as the main frame with holes drilled through to allow modular addition of legs and spacers. Legs were attached to the two pieces of the frame to raise them 1⅛" and spacers of 5&10 cm were used to immobilize the two pieces 5 or 10 cm apart in a parallel configuration. Adjustable pieces like those used in Example 3 were attached to the ends of the bar to hold a 1" diameter roller on each end.

Tracks were assembled according to the procedure described in Example 3 with the dimensions of 42×2 cm.

The rods were attached to the smart motors by a collar and controlled in the same way as described in Example 3.

Polymers as described above in Example 3 were electrospun onto the formed collection device. Two parallel strips of SEM tape were placed on microscope stub and an aligned fiber array was collected for 1, 2.5, 5, or 7.5 minutes in an orientation perpendicular to the tape. Samples were analyzed using SEM and fibers per unit length in the direction of the tape was counted using ImagePro Plus 4.0. Six to nine measurements were averaged for each of three trials per collection time. The exact electrospinning parameters for the fiber rate were 18% PCL solution dissolved in 3:1 DCM:DMF was feed through a 23 g needle 11 cm above the collection area at 0.015 ml/min with an applied voltage of 12 kV.

Fibers were continuously collected over a period of up to about five hours with track velocities of up to 0.05 m/sec.

Fiber bundles were directly collected using the device through use of a static rack placed at the end of the tracks. Shear forces as described above cut the fibers from the movable collection surfaces leaving the fibers to be collected on the grounded static rack.

It will be appreciated that the foregoing examples, given for purposes of illustration, are not to be construed as limiting the scope of this disclosure. Although only a few exemplary embodiments have been described in detail above, those skilled in the art will readily appreciate that many modifications are possible in the exemplary embodiments without materially departing from the novel teachings and advantages of this disclosure. Accordingly, all such modifications are intended to be included within the scope of this disclosure which is herein defined and all equivalents thereto. Further, it is recognized that many embodiments may be conceived that do not achieve all of the advantages of some embodiments, yet the absence of a particular advantage shall not be construed to necessarily mean that such an embodiment is outside the scope of the present disclosure.

What is claimed is:

1. A method of forming an array of nanofibers comprising:

electrospinning a first nanofiber from an electrospinning nozzle, the electrospinning nozzle defining an axis;

depositing the first nanofiber at a deposition area, the deposition area being defined by a first conductive collection surface and a second conductive collection surface, the first and second conductive collection surfaces being separated from one another by a space, wherein the first nanofiber is of finite length defined between a first end of the first nanofiber and a second end of the first nanofiber such that the first end of the first nanofiber is adhered to the first conductive collection surface and the second end of the first nanofiber is adhered to the second conductive collection surface;

moving the first conductive collection surface and the second conductive collection surface such that the first nanofiber is moved in a direction away from the deposition area and into a collection compartment;

electrospinning a second nanofiber from the electrospinning nozzle;

depositing the second nanofiber at the deposition area subsequent to the motion of the first nanofiber away from the deposition area and into the collection compartment;

moving the first collection surface and the second collection surface such that the second nanofiber is moved in a direction away from the deposition area and into the collection compartment, the first and second nanofibers being aligned with one another and spaced apart from one another within the collection compartment, the first and second nanofibers being substantially perpendicular to the axis of the electrospinning nozzle.

2. The method according to claim 1, wherein the first and second collection surfaces move parallel to one another.

3. The method according to claim 1, wherein the first and second collection surfaces move at the same speed as one another.

4. The method according to claim 1, wherein the direction away from the deposition area is a direction normal to that defined by the axis of the electrospinning nozzle.

5. The method according to claim 1, wherein the direction away from the deposition area is a direction that is the same as the direction defined by the axis of the electrospinning nozzle.

6. The method according to claim 1, further comprising electrospinning an additive in conjunction with the first nanofiber.

7. The method according to claim 1, wherein the electric field of the electrospinning process remains consistent throughout the array formation process.

8. The method according to claim 1, further comprising removing the first and second electrospun nanofibers from the first and second collection surfaces.

9. The method according to claim 8, further comprising manipulating the first and second electrospun nanofibers to form an array having a predetermined geometry.

* * * * *

UNITED STATES PATENT AND TRADEMARK OFFICE

CERTIFICATE OF CORRECTION

PATENT NO. : 8,580,181 B1
APPLICATION NO. : 12/896268
DATED : November 12, 2013
INVENTOR(S) : Beachley et al.

It is certified that error appears in the above-identified patent and that said Letters Patent is hereby corrected as shown below:

In the specification

Column 1, lines 16 - 19 states,

"The United States Government may have rights to this invention pursuant to a grant from the National Institute of Neurological Disorders and Stroke, grant number R01NS050243."

Please correct this paragraph to read as follows:

-- This invention was made with government support under grant #NS050243 awarded by The National Institutes of Health. The government has certain rights in the invention. --

Signed and Sealed this
Twenty-sixth Day of April, 2016

Michelle K. Lee

Michelle K. Lee
*Director of the United States Patent and Trademark Office*